US006393837B1

(12) United States Patent
Tomioka

(10) Patent No.: US 6,393,837 B1
(45) Date of Patent: May 28, 2002

(54) AIR TOOL WITH SAFETY DEVICE

(75) Inventor: Isao Tomioka, Osaka (JP)

(73) Assignee: Fuji Air Tools Co., Inc. (JP)

( * ) Notice: Subject to any disclaimer, the term of this patent is extended or adjusted under 35 U.S.C. 154(b) by 0 days.

(21) Appl. No.: 09/606,272

(22) Filed: Jun. 29, 2000

(30) Foreign Application Priority Data

Jun. 29, 1999 (JP) ..... 11-183800

(51) Int. Cl.[7] ..... F16D 31/02
(52) U.S. Cl. ..... 60/399
(58) Field of Search ..... 60/399; 173/166, 173/176, 179, 156, 92

(56) References Cited

U.S. PATENT DOCUMENTS 4,222,702 A * 9/1980 Rush ..... 415/25
4,729,436 A * 3/1988 Amador et al. ..... 173/12

* cited by examiner

*Primary Examiner*—Edward K. Look
*Assistant Examiner*—Michael Leslie
(74) *Attorney, Agent, or Firm*—Morrison Law Firm

(57) ABSTRACT

A rotary air tool includes an axially moving automatic speed control valve which responds to changes in rotary speed by varying the amount of air fed to its air motor. When the speed tends to increase under light load, less air is fed to the air motor to maintain a generally constant rotary speed. A safety device is triggered when the speed exceeds a predetermined maximum due, for example, to a malfunction in the speed control valve. The safety device includes a weight which is radially movable at the predetermined maximum speed to release a latch. The latch permits resilient actuation of the speed control valve toward its closed position. In one embodiment, a second latch maintains the safety device in the actuated condition so that the air tool remains substantially shut off until the reason for the overspeed condition is investigated. In a further embodiment, the speed control valve is not fully closed by actuation of the safety device so that at least a small amount of air is admitted to the air motor.

7 Claims, 5 Drawing Sheets

Prior Art

AIR TOOL WITH SAFETY DEVICE

BACKGROUND OF THE INVENTION

1. Field of the Invention

The present invention relates to an air tool such as an air grinder or the like with a safety device.

2. Description of the Related Art

Conventionally, an air grinder driving an abrasive member prevents over-speed by reducing the amount air consumption at low load and by increasing the amount of air at heavy load. Such control maintains a roughly constant speed at all values of load. For these purposes, an air grinder generally includes a speed adjusting apparatus capable of controlling the rotational speed at high and low load.

Referring now to FIGS. 4, 5*a* and 5*b*, a speed adjusting apparatus 30 in a main body casing 28 of a prior art air grinder includes a rotary member 31 having a flange portion near the center on a side surface of a cylinder. A speed adjusting valve body 36 includes a flange portion near the bottom of the side surface of the cylinder. A speed adjusting weight 32, having a substantially L-shaped cross section as seen from the side is pivoted below rotary member 31.

A valve seat 38 is interposed in an air passage 29 within the main body casing 28. An air motor 40 is driven by air supplied through the air passage 29. The rotary member 31 is directly connected to an output shaft 41 of the air motor 40. Rotation of the air motor 40 is directly transferred to the rotary member 31. The speed adjusting valve body 36 is fitted to the outside of the rotary member 31. The speed adjusting valve body 36 is free to slide in an axial direction along the outer surface of the rotary member 31. The speed adjusting valve body 36 and the valve seat 38 of the air passage 29 are positioned facing each other.

Spring receivers 39, 39 protrude diametrically outward on both opposing side surfaces above the rotary member 31. The respective spring receivers 39 and 39 are fitted into axially elongated holes pierced through opposing side surfaces of the rotary member 31 above the speed adjusting valve body 36. A speed adjusting valve spring 37 is interposed between the spring receivers 39, 39 and the flange portion of the speed adjusting valve body 36. The speed adjusting valve body 36 is urged by the speed adjusting valve spring 37 in a direction away from the valve seat 38.

The speed adjusting weights 32 and 32, having an a substantially L-shaped cross section as seen from a side view, are each pivoted on a pin 34. The speed adjusting weights 32, 32 each includes a weight portion 33 and a lever portion 35. As the rotational speed of rotary member 31 increases, the weight portions of the speed adjusting weights 32, 32 are urged outward by centrifugal force about their pins 34, 34. This tilts the speed adjusting weights 32, 32, as shown in FIG. 5*a* so that the lever portions 35, 35 apply an upward force on the flange portion of the rotary member 31.

In operation, at light load, the speed adjusting apparatus 30 assumes the configuration shown in FIG. 5*a*. Centrifugal force on the weight portions 33, 33 of the speed adjusting weight 32, 32 due to the rotation of the air motor 40, tilts the weight portions 33, 33 outward around their respective pins 34, 34. The lever portions 35, 35, in contact with the flange portion of the speed adjusting valve body 36, apply a force in an upward direction for urging the speed adjusting valve body 36. This moves speed adjusting valve body closer to the valve seat 38. When the thrust applied by the speed adjusting weights 32, 32 exceeds the opposing force of the speed adjusting valve spring 37, the speed adjusting valve body 36 is displaced upward, thereby decreasing the effective opening of the air passage through the valve seat 38. As a result, the amount of air supplied through the air passage 29 is reduced, and the rotational speed is correspondingly reduced.

Referring now to FIG. 5*b*, under heavy load on an abrasive member, such as a grindstone or the like (not shown), the rotational speed of the air motor 40 is reduced. As a result, the centrifugal force applied to the speed adjusting weight 32 is reduced. Accordingly, the thrust applied in the upward direction to speed adjusting valve body 36 is also reduced. Accordingly, the speed adjusting valve body 36 is pressed downward by the speed adjusting valve spring 37 to move the speed adjusting valve body away from the valve seat 38. This increases the effective opening of the air passage thereof As a result, an amount of air supplied from the air passage 29 is increased, and the torque output of the air motor 40 is increased. As a result, slowing of the air motor 40 under heavy load is reduced. As mentioned above, the rotational speed of the air motor is automatically adjusted by the speed adjusting apparatus 30.

However, if the speed adjusting apparatus 30 mentioned above does not operate normally for some reason, for example, because of foreign material in the speed adjusting apparatus 30, a dangerous over-speed condition may result. In the conventional device, the only way to prevent this danger is to perform periodic inspections by dismantling the device.

OBJECTS AND SUMMARY OF THE INVENTION

It is an object of the present invention to provide an air tool which overcomes the conventional disadvantages mentioned above.

It is a further object of the invention to provide an air tool having a safety device which automatically reduces the rotational rate and locks the air tool to inhibit normal use when rotation generated by an air motor of the air tool exceeds a predetermined rotational speed.

Then, in accordance with a first aspect of the present invention, there is provided an air tool with a safety device comprising: a main body casing 22, an air passage 23 formed within the main body casing 22, an air motor 26 rotated by air supplied from the air passage 23, a valve seat 24 interposed in the air passage 23, a safety valve body 4 arranged in such a manner as to change an effective opening of the passage by moving in a direction of moving close to and apart from the valve seat 24, first urging means 6 for urging the safety valve body 4 in a direction of moving close to the valve seat 24, a rotary member 2 rotating in interlocking with an output shaft 25 of the air motor 26, a safety valve stopper 16 mounted to the rotary member 2 so as to be displaced outward in a diametrical direction due to a centrifugal force generated by a rotation of the rotary member 2, and second urging means 20 for urging the safety valve stopper 16 in a direction inverse to a direction in which the centrifugal force is applied, wherein a lock mechanism for locking a motion of the safety valve body 4 in a steady operation state that the safety valve body 4 moves apart from the valve seat 24 against an urging force of the first urging means 6 so as to increase an effective opening of the passage, disengaging the lock so as to move the safety valve body 4 in a direction of moving close to the valve seat 24 by the first urging means 6, thereby reducing the effective opening of the passage when a rotation rate of the output shaft 25 of the air motor 26 is increased to be over a predetermined rotation rate and the safety valve stopper 16 moves against the urging force of the second urging means 20 due to the centrifugal force, and again locking the motion of the safety valve body 4 in this state is provided between the safety valve body 4 and the safety valve stopper 16.

In accordance with the air tool with the safety device described in the first aspect mentioned above, when the rotational speed of the output shaft 25 of the air motor 26 exceeds a predetermined speed of rotation, for example, 10 to 15% of a normal rotational speed, the safety valve stopper 16 locking the motion of the safety valve body 4 mentioned above moves against the urging force of the second urging means 20 due to the centrifugal force so as to disengage the lock, and the safety valve body 4 mentioned above moves close to the valve seat 24 due to the urging force of the first urging means 6 so as to reduce the effective opening of the passage of the valve seat 24 mentioned above, thereby limiting the amount of air supplied from the air passage 23. To maintain the locked condition mentioned above, the safety valve stopper 16 again locks the motion of the safety valve body 4.

In accordance with a second aspect of the present invention, there is provided an air tool with a safety device, further comprising air supply means for supplying a small amount of air from the air passage 23 the safety valve body 4 during the locked condition.

In accordance with the air tool with the safety device described in the second aspect, an abrasive member such as a grindstone or the like is prevented from being disengaged or cracked due to a sudden stoppage of rotation by continuously supplying a small amount of air from the air passage 23 so as to continue at low speed.

Further, in accordance with a third aspect of the present invention, there is provided an air tool with a safety device, wherein the rotary member 2 is directly connected to the output shaft 25 of the air motor 26, and the safety valve body 4 is supported to the rotary member 2 so as to be coaxial with a rotational axis thereof.

In accordance with the air tool with the safety device described in the third aspect, since the rotary member 2 and the safety valve body 4 are coaxial with the output shaft 25 of the air motor 26, the structure can be made more compact.

In accordance with a fourth aspect of the present invention, there is provided an air tool with a safety device, wherein the air tool with the safety device as recited in the third aspect further comprises: a speed adjusting valve body 7 arranged in such a manner as to slide substantially in a coaxial manner, third urging means 11 for urging the speed adjusting valve body 7 in a direction of moving apart from the valve seat 24, and a speed adjusting weight 12 supported to the rotary member 2 in such a manner as to be displaced due to a centrifugal force caused by the rotation of the rotary member 2, and wherein an interlocking mechanism for reducing the effective opening of the passage by moving the speed adjusting valve body 7 close to the valve seat 24 due to a displacement of the speed adjusting weight 12 is provided between the speed adjusting valve body 7 and the speed adjusting weight 12.

In accordance with the air tool with the safety device described in the fourth aspect, since the speed adjusting apparatus capable of automatically controlling the rotation rate in a coaxial manner with the safety device is mounted, it is possible to construct the safety device and the speed adjusting apparatus compact.

The invention provides an air tool with a safety device structured to automatically reduce a rotation rate and lock the air tool in a locked condition so as to inhibit normal use in the case that the rotation generated by an air motor of the air tool such as the air grinder or the like exceeds a predetermined rotation rate. The air tool with the safety device has a main body casing 22, an air passage 23 formed within the main body casing 22, an air motor 26 rotated by air supplied from the air passage 23, a valve seat 24 interposed in the air passage 23, a safety valve body 4 arranged in such a manner as to change an effective opening of the passage by moving in a direction of moving close to and apart from the valve seat 24, first urging means 6 for urging the safety valve body 4 in a direction of moving close to the valve seat 24, a rotary member 2 rotating in interlocking with an output shaft 25 of the air motor 26, a safety valve stopper 16 mounted to the rotary member 2 so as to be displaced outward in a diametrical direction due to a centrifugal force generated by a rotation of the rotary member 2 and second urging means 20 for urging the safety valve stopper 16 in a direction inverse to a direction in which the centrifugal force is applied. In this air tool with the safety device, a lock mechanism for locking a motion of the safety valve body 4 in a steady operation state that the safety valve body 4 moves apart from the valve seat 24 against an urging force of the first urging means 6 so as to increase an effective opening of the passage, disengaging the lock so as to move the safety valve body 4 in a direction of moving close to the valve seat 24 by the first urging means 6, thereby reducing the effective opening of the passage when a rotation rate of the output shaft 25 of the air motor 26 is increased to be over a predetermined rotation rate and the safety valve stopper 16 moves against the urging force of the second urging means 20 due to the centrifugal force, and again locking the motion of the safety valve body 4 in this state is provided between the safety valve body 4 and the safety valve stopper 16.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
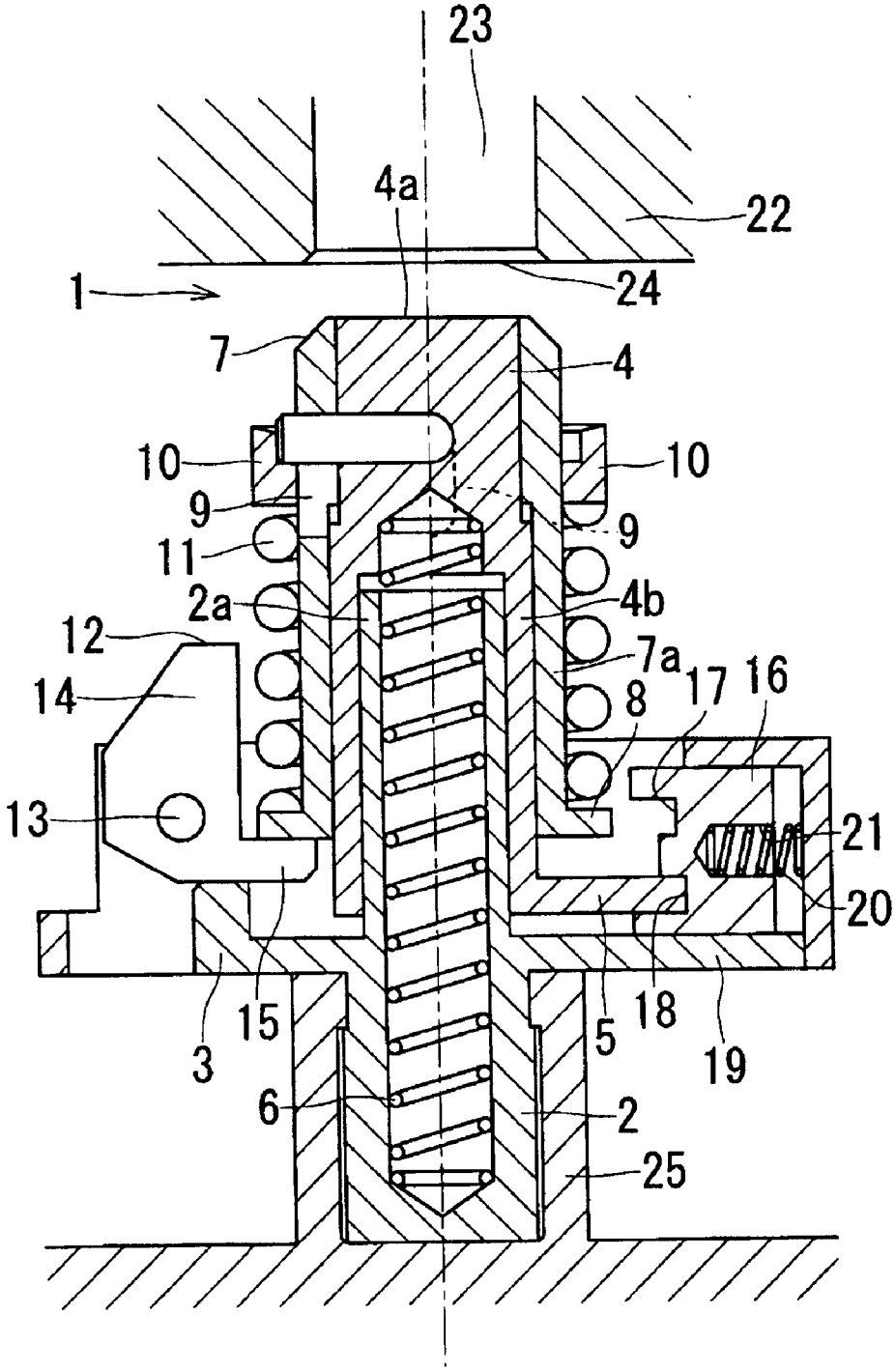
FIG. 1 is a side elevational cross sectional view of an air grinder in accordance with the present embodiment during steady operation.
Figure 2:
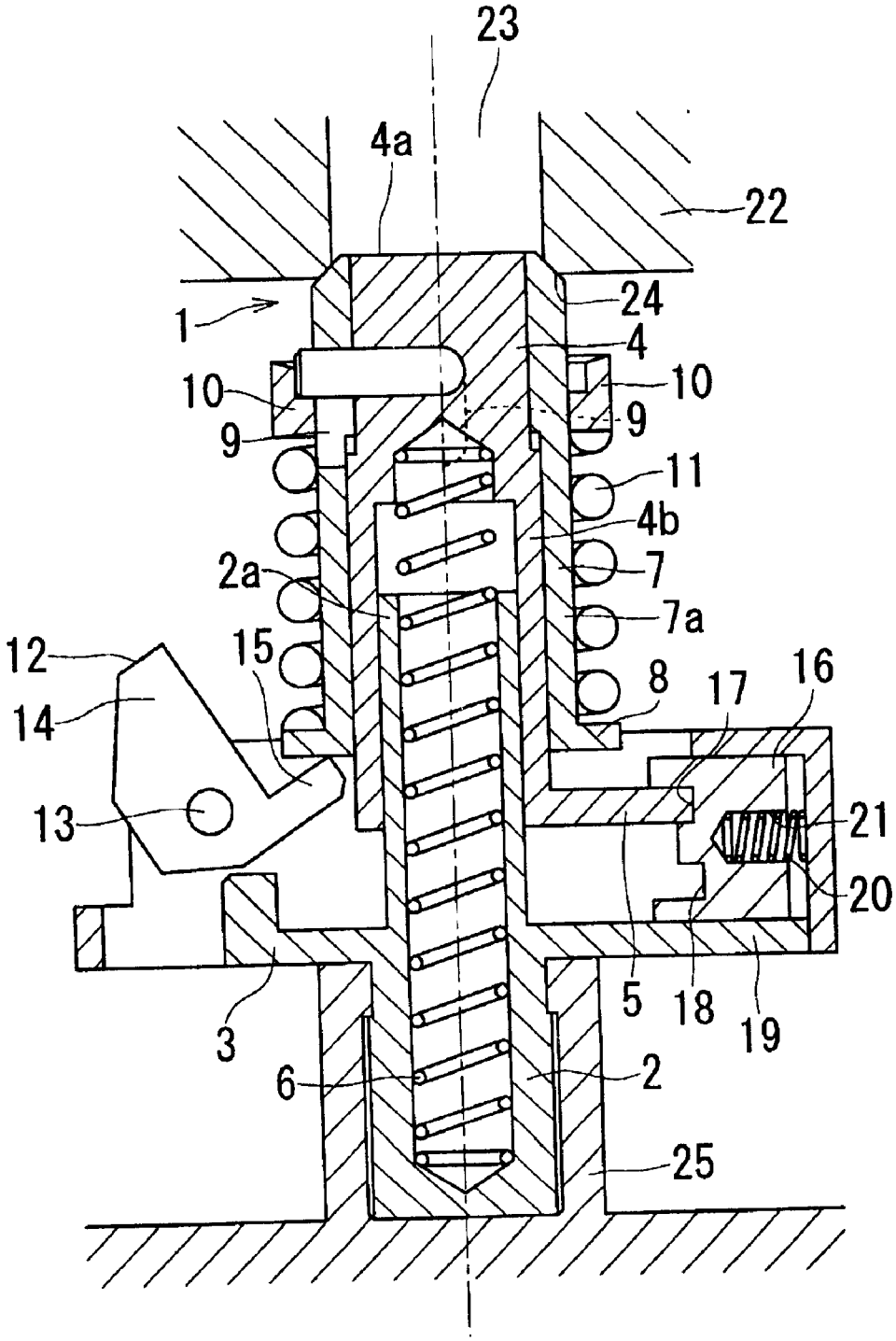
FIG. 2 is a side elevational cross sectional view showing an operating state of the air grinder with the safety device in accordance with the present embodiment after the safety device is triggered and locked.
Figure 3:
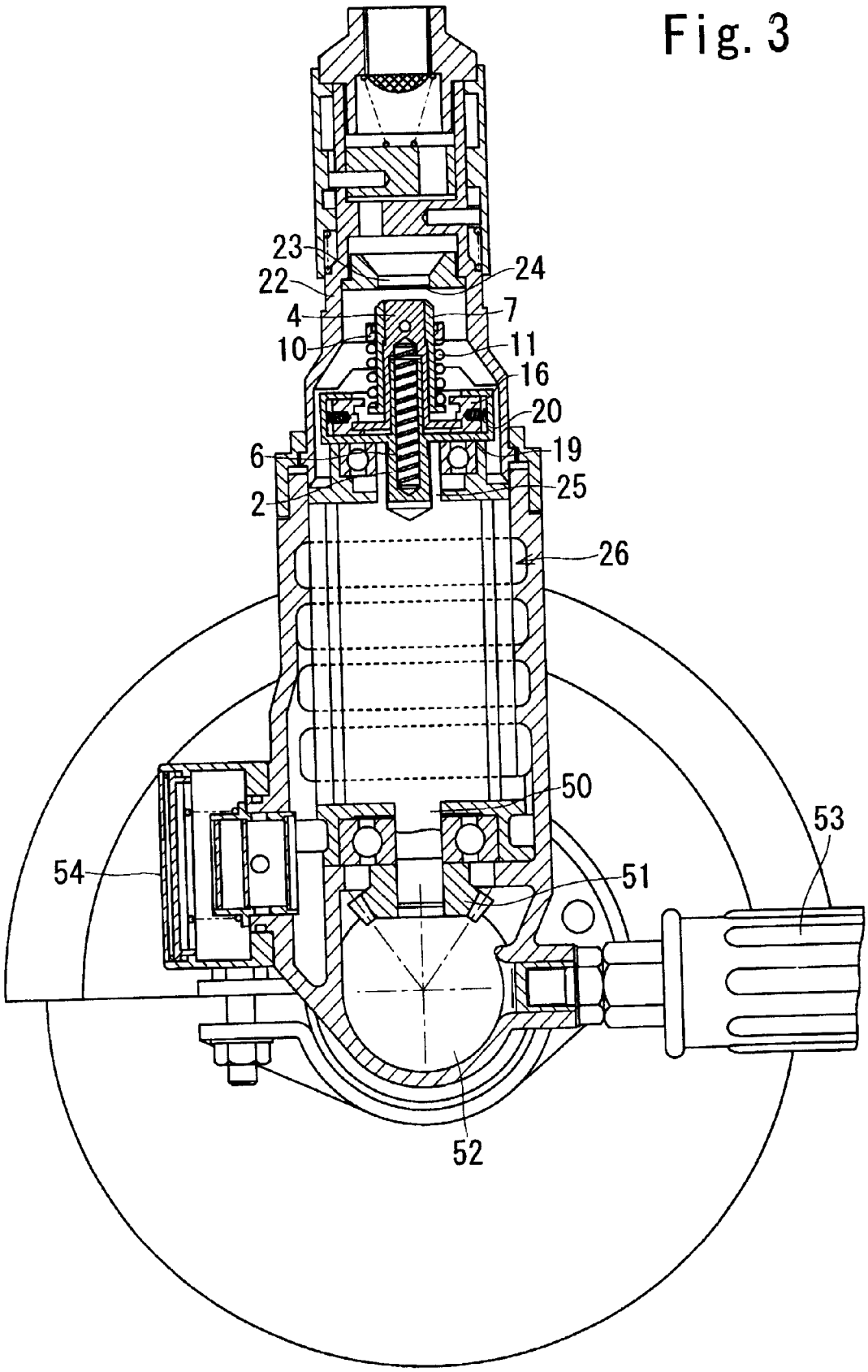
FIG. 3 is a plan cross sectional view showing a whole structure of an air grinder.
Figure 4:
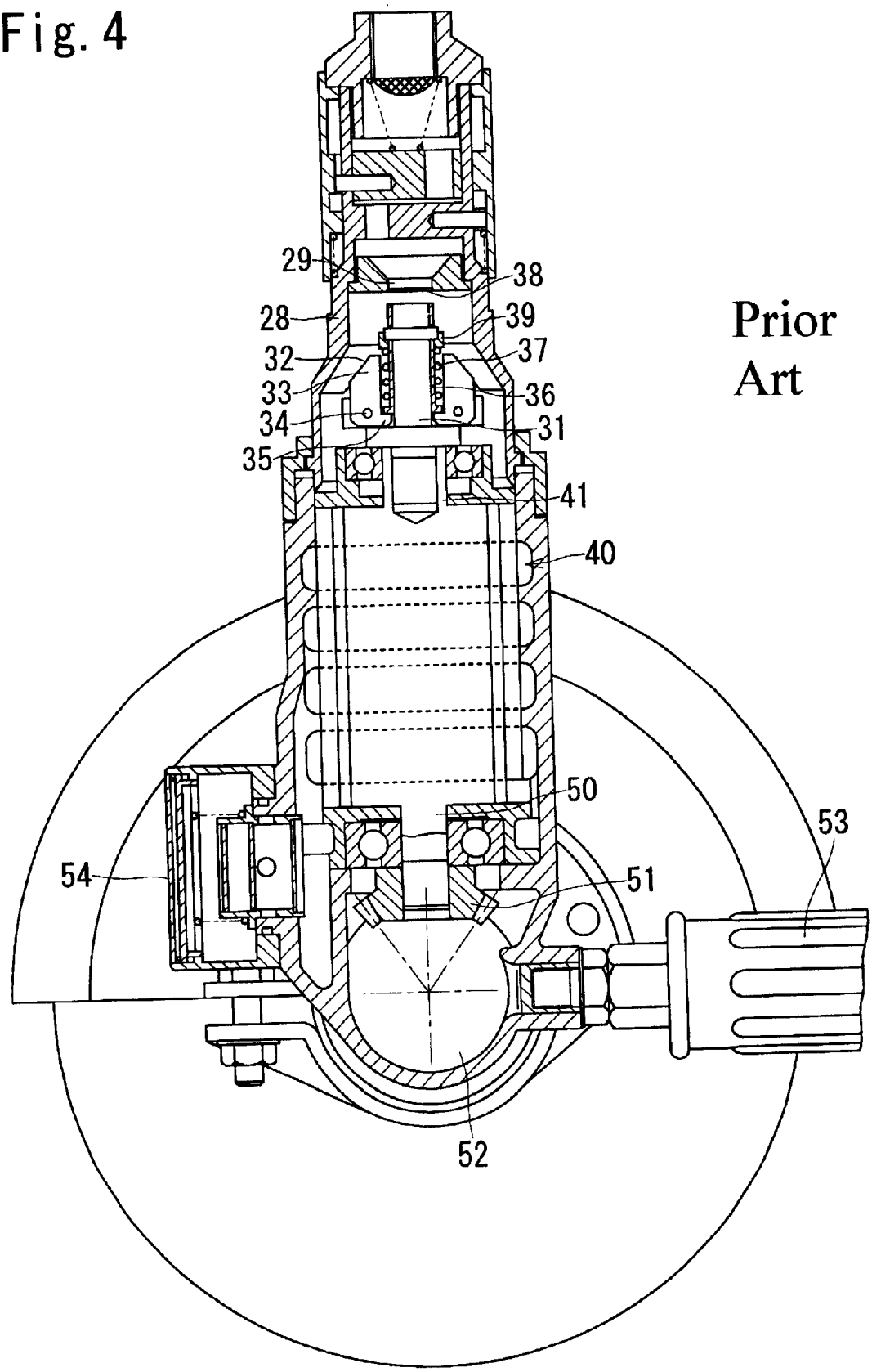
FIG. 4 is a plan cross sectional view showing a whole structure of a conventional air grinder.
Figure 5A:
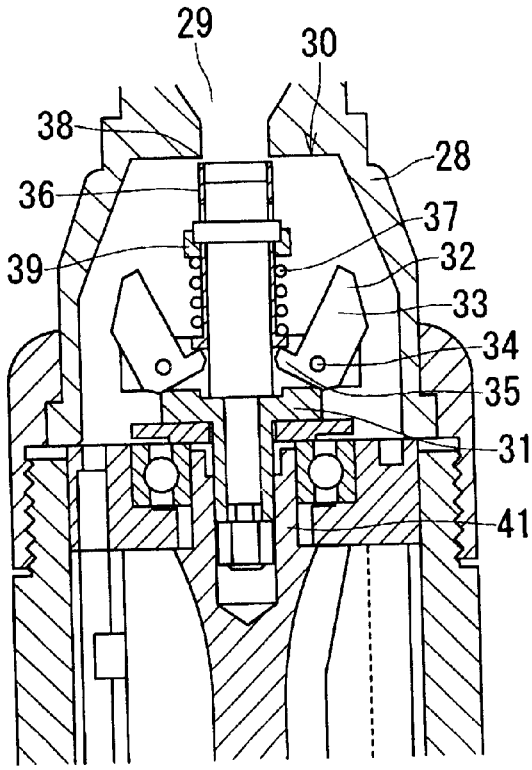
FIG. 5*a* shows a side elevational cross sectional view of a speed adjusting apparatus operating state under light load.
Figure 5B:
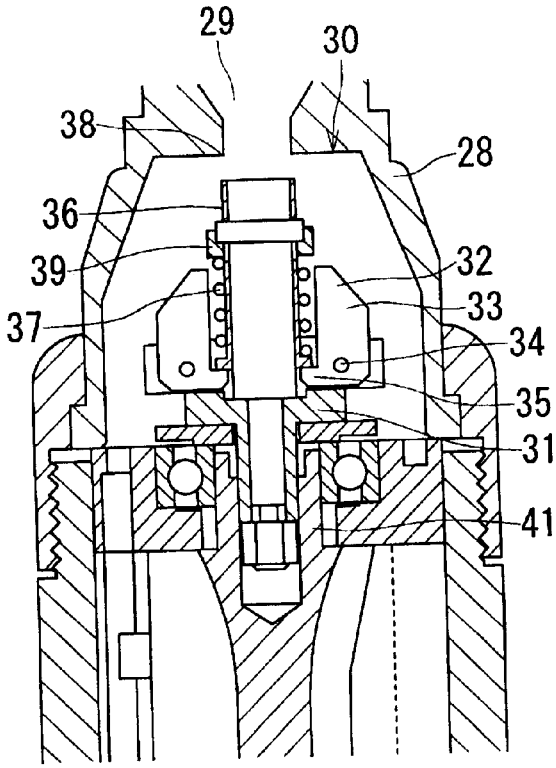
FIG. 5*b* shows a side elevational cross sectional view of the speed adjusting apparatus under applied load.

Referring to FIGS. 1, 2 and 3, a safety device 1 within a main body casing 22 includes a rotary member 2 having a flange portion 3 near the center of a side surface of a cylindrical portion 2*a* formed in a cylindrical shape with a bottom. A safety valve body 4 includes a flange portion 5 in a bottom portion on a side surface of a cylindrical portion 4*b*.

The safety valve body 4 has a closed top portion 4*a*. A speed adjusting valve body 7 includes a flange portion 8 at its bottom extending outward from a side surface of a cylindrical portion 7*a*. A speed adjusting weight 12, having an L-shaped cross section, is pivoted on a pin 13. A safety valve stopper 16 has a cross section resembling an E.

As shown in FIGS. 1 and 3, a valve seat 24 is interposed in an air passage 23 formed within the main body casing 22. An air motor 26 is rotated and driven by air supplied through the air passage 23. The rotary member 2 is directly connected to an output shaft 25 at the rear of the air motor 26. The rotation of the air motor 26 is thus directly transferred to the rotary member 2.

As shown in FIG. 1, the cylindrical portion 4*b* of the safety valve body 4 is fitted to a portion above the flange 3 outside the cylindrical portion 2*a* of the rotary member 2. Safety valve body 4 can slide in an axial direction. The cylindrical portion 7*a* of the speed adjusting valve body 7 is fitted to an outside portion of the cylindrical portion 4*b* of the safety valve body 4 slideable in an axial direction. The speed adjusting valve body 7 and the safety valve body 4 are both arranged opposing the valve seat 24. A small gap remains between the cylindrical portion 4*b* of the safety valve body 4 and the cylindrical portion 7*a* of the speed adjusting valve body 7. This small gap permits at least a small amount of air to be supplied to the air motor 26 even when the safety valve body 4 and the speed adjusting valve body 7 are actuated to close the valve seat 24.

A safety valve spring 6, corresponding to a first urging means, is interposed inside the cylindrical portions 2*a* and 4*a* of the rotary member 2 and the safety valve body 4. The safety valve spring urges the safety valve body 4 toward its closing position with the valve seat 24. In FIG. 3, an output shaft 50 is disposed in a front end of the air motor 26. Bevel gears 51 and 52 are located at the rear of the air motor 26. A grip portion 53 extends radially at the rear of the device. A muffler chamber 54 at the rear reduces the noise of exhaust.

A guide portion 19, having a C-shaped cross section, is mounted at one end of the flange portion 3 of the rotary member 2. The safety valve stopper 16 is mounted in the guide portion 19. The safety valve stopper 16 is free to slide outward in a diametrical direction thereof due to a centrifugal force caused by a rotation of the rotary member 2. The E-shaped cross section of the safety valve stopper 16 is formed by grooves 17 and 18 corresponding to a width of the flange portion 5 of the safety valve body 4 in an upper portion and a lower portion on one side surface of a rectangular parallelepiped. This surface is opposed to the flange portion 5 of the safety valve body 4. One end of the flange portion 5 of the safety valve body 4 can be fitted into the grooves 17 and 18. The flange portion 5 of the safety valve body 4 and the grooves 17 and 18 serve as a safety lock. A hole with a bottom 21 is located on a side surface opposite to the grooves 17 and 18. A safety valve stopper spring 20, corresponding to second urging means, is interposed within the hole 21. The safety valve stopper spring 20 urges the safety valve stopper 16 inward in a diametrical direction, that is, in a direction opposite to a direction in which the centrifugal force is applied.

Spring receivers 10 and 10 protrude outward in a diametrical direction on both opposing side surfaces above the cylindrical portion 4*b* of the safety valve body 4. The spring receivers 10 and 10 are introduced to an external portion through axially elongated holes 9 and 9 pierced through opposing side surfaces above the cylindrical portion 7*a* of the speed adjusting valve body 7. A speed adjusting valve spring 11, corresponding to third urging means, is interposed between the spring receiver 10 and the flange portion 8 of the speed adjusting valve body 7. The speed adjusting valve body 7 is urged by the speed adjusting valve spring 11 in a direction tending to move it apart from the valve seat 24.

The L-shaped speed adjusting weight 12 is supported in the flange portion 3 of the rotary member 2 so as to be tilted due to a centrifugal force caused by a rotation of the rotary member 2. The speed adjusting weight 12 includes a weight portion 14 for tilting inward and outward in an axial direction around the pin 13, and a lever portion 15 for moving the speed adjusting valve body 7 with respect to the valve seat 24 in accordance with a tilting motion thereof That is, the speed adjusting weights 12 are positioned between a pair of support members respectively formed at opposing portions on the flange portion 3 of the rotary member 2 and are supported by the pins 13 so as to be free to tilt. The flange portion 8 of the speed adjusting valve body 7 and the lever portion 15 of the speed adjusting weight 12 contact the lower side of the flange portion to constitute an interlocking mechanism for adjusting an effective opening of the passage of the valve seat 24.

Referring especially to FIG. 1, under no load or light load applied to a grindstone corresponding to the abrasive member, the centrifugal force applied to the speed adjusting weight 12 due to the rotation of the air motor 26, tends to tilt the weight portion 14 outward around the pin 13. This urges the lever portion 15 into contact with the flange portion 8 of the speed adjusting valve body 7. This applies an upward force on the speed adjusting valve body 7. This force tends to move the speed adjusting valve body closer to the valve seat 24. When the thrust from the speed adjusting weight 12 is greater than the urging force of the speed adjusting valve spring 11, the speed adjusting valve body 7 moves upward by sliding along the surface of the safety valve body 4. This motion tends to partially close the valve seat 24 positioned facing the speed adjusting valve body 7. This reduces the effective opening of the valve seat 24. As a result, the amount of air supplied from the air passage 23 is reduced, and the rotational speed is controlled.

When a load is applied to the grindstone, and the rotational speed of the air motor 26 is reduced, the centrifugal force applied to the speed adjusting weight 12 is correspondingly reduced. Accordingly, the thrust of the speed adjusting weight 12 forcing the speed adjusting valve body 7 upward is reduced. As a result the speed adjusting valve body 7 is urged downward. This moves the speed adjusting valve body 7 away from the seat 24 under the urging force of the speed adjusting valve spring 11. As a consequence, the effective opening of the passage through the speed adjusting valve body is increased. As a result, the amount of air supplied from the air passage 23 is increased, and the output of the air motor 26 is increased, whereby the rotation rate of the air motor is correspondingly increased.

During steady operation, one end of the flange portion 5 in the safety valve body 4 remains fitted into the groove 18 in the lower portion of the safety valve stopper 16 so as to lock the motion of the safety valve body 4, the safety valve body 4 and the speed adjusting valve body 7. Thus, at low speed, these elements cannot move in a vertical direction by thrust from tilting of the speed adjusting weight 12 and the urging force of the speed adjusting valve spring 11.

When the rotation rate of the air motor 26 and the output shaft 25 exceeds a predetermined limit, the safety device of the apparatus operates. Referring to FIG. 2, when the rotation speed of the output shaft 25 of the air motor 26 exceeds by, for example, 10 to 15% of a safe rotation rate, the centrifugal force applied to the safety valve stopper 16 is increased. The safety valve stopper 16 slides outward in a diametrical direction on the guide portion 19 of the rotary member 2 against the urging force of the safety valve stopper spring 20. When the flange portion 5 of the safety valve body 4 is disengaged from the groove 18 in the lower portion of the safety valve stopper 16, the lock mechanism locking the motion of the safety valve body 4 is disengaged. This permits the safety valve body 4 to be displaced upward, that is, in a direction which tends to close to the valve seat 24 due to the urging force of the safety valve spring 6 so as to close the valve seat 24. At this time, the speed adjusting valve body 7 disposed in the outer side is also pressed upward together with the safety valve body 4 so as to close the valve seat 24. However, since a fixed gap remains between the safety valve body 4 and the speed adjusting valve body 7, a small amount of air is supplied to the air motor 26 through the gap.

In this case, the groove 17 disposed in the upper portion of the safety valve stopper 16 is moved to a position opposed to the flange portion 5 when the safety valve body 4 is being pressed upward. Accordingly, when the amount of air supplied due to reduction of the effective opening of the passage is limited and the centrifugal force is reduced, the safety valve stopper 16 is again pressed back inward in a diametrical direction while sliding on the guide portion 19 due to the urging force of the safety valve stopper spring 20. The flange portion 5 of the safety valve body 4, when it is close to the valve seat 24, engages the groove 17 disposed in the upper portion thereof, thereby locking, or latching the safety valve body 4 in this condition.

Because of the lock or latching performed by fitting flange portion 8 into the groove 17, the safety valve body 4 and the speed adjusting valve body 7 are prevented from being again pressed back by the pressure of the air supplied to the safety valve body 4 from the air passage 23. When the safety valve body 4 is locked by the lock mechanism as described above, the air tool cannot be operated until it is disassembled for inspection and/or repair. Accordingly, dangerous operation is prevented, and thereby safety is improved.

Further, since a small amount of air continues ton be supplied through the small gap between the safety valve body 4 and the speed adjusting valve body 7, rotation is not suddenly stopped even when the safety device is operated. The small gap is sized to permit operation at a relatively low speed of, for example, about 20 to 25% of the normal rotational speed. In a typical air tool, this speed may be about 1500 to 2000 revolutions per minute. Since rotation is not completely stopped as mentioned above, disengagement and cracking of a grindstone resulting from sudden stoppage is prevented.

Since the rotary member 2, the safety valve body 4 and the speed adjusting valve body 7 are coaxial with the output shaft 25 of the air motor 26, the air tool may be generally as compact as an air tool with a conventional speed adjusting apparatus.

It is to be noted that the center arm of the E-shaped profile of the safety valve stopper 16 is shorter than the two outer arms. As a result, when the safety valve stopper 16 is moved outward sufficiently for the flange portion 5 to clear the center arm when the flange portion reaches the upper arm, the extra length of the upper arm causes the flange portion 5 to contact the inner surface of the upper arm, aligned with the groove 17. Since the rotation rate is slowed by the upward movement of the safety valve stopper 16, the centrifugal force urging the safety valve stopper 16 outward is reduced, and the safety valve stopper 16 then is returned toward the axis, thus capturing the flange portion 5 in the groove 17.

The above description is given of the embodiment of the air tool with the safety device in accordance with the present invention. However, the present invention is not limited to the embodiment mentioned above, and can be variously modified without departing from the spirit and scope of the invention.

That is, in the above embodiment, a small amount of air continues to be supplied through a small gap between the safety valve body 4 and the speed adjusting valve body 7 after the safety device is triggered. This small amount of air is effective to maintain, for example, rotation at 20 to 25% of the set rotation speed. However, the disclosed gap may be replaced with an air hole pierced through a part of the wall forming the valve seat 24, thereby permitting the supply of a small amount of air. Further, the structure may be made such that the size relations between the respective elements are selected so that a small gap is remains between the safety valve body 4 and the speed adjusting valve body 7, and the valve seat 24 when the safety valve body 4 and the speed adjusting valve body 7 are integrally lifted upward, thereby communicating a small amount of air therepast and controlling the rotational speed at a reduced value.

Further, in the embodiment mentioned above, the safety valve stopper 16 with the E-shaped grooves 17 and 18, and the flange portion 5 of the safety valve body 4 are employed as the lock mechanism for locking the motion of the safety valve body 4 when the safety device is operated. However, the structure may be made in the inverse manner to the manner mentioned above. That is, a protruding portion may be provided in the safety valve stopper 16 and a groove corresponding thereto may be provided in the safety valve body 4, thereby being fitted to each other.

Further, the structure may be made with a weight formed substantially in an L shape in a side view and being capable of tilting inward and outward due to a centrifugal force, similar to the speed adjusting weight 12 mentioned above. In this case, the lever portion thereof is brought into contact with the upper side of the flange portion 5 of the safety valve body 4 mentioned above during normal operation so as to lock the motion of the safety valve body 4 mentioned above. When the predetermined rotational speed is exceeded, the weight is tilted outward by the centrifugal force. This disengages the lock and the safety valve body 4 is lifted upward to close the valve seat 24. The weight is again tilted inward by the urging means to maintain the triggered condition with the lever portion in contact with the lower side of the flange portion 5 of the safety valve body 4, thereby locking the motion of the safety valve body 4.

As mentioned above, in accordance with the air tool with the safety device as described in the first aspect, since the apparatus can be again operated only after disassembly and repair after the rotation rate of the output shaft of the air motor exceeds the predetermined value, the safety device is operated and the motion of the safety valve body is locked by the lock mechanism. This prevents operation from being continued in a dangerous condition, thereby improving safety.

Further, in accordance with the air tool with the safety device described in the second aspect, an abrasive member such as a grindstone or the like is prevented from being disengaged or cracked due to a sudden stop of rotation by continuously supplying a small amount of air from the air passage so as to continue rotation at a lower speed, thereby further improving safety.

Further, in accordance with the air tool with the safety device described in the third aspect, since the rotary member and the safety valve body are coaxial with the output shaft of the air motor, the structure can be made compact.

In accordance with the air tool with the safety device described in the fourth aspect, since the speed adjusting apparatus for controlling the rotation rate is capable of automatically controlling the rotation rate in a coaxial manner with the safety device, the construction including the safety device and the speed adjusting apparatus can be compact.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An air tool with a safety device comprising:

a main body casing;

an air passage in said main body casing;

an air motor rotated by air supplied through said air passage;

a valve seat in said air passage;

a safety valve body movable toward and away from said valve seat to change an effective opening of said air passage;

first urging means for urging said safety valve body in a direction to ward said valve seat;

a rotary member rotating with an output shaft of said air motor;

a safety valve stopper connected to said rotary member;

said safety valve stopper being displaceable outward in a diametrical direction by a centrifugal force generated by a rotation of said rotary member;

second urging means for urging said safety valve stopper in a direction opposite to a direction in which said centrifugal force is applied;

a lock mechanism for locking a motion of said safety valve body during steady operation;

said first urging means urging said safety valve body away from said valve seat thereby moving said safety valve body away from said valve seat against an urging force of said first urging means thereby increasing an effective opening of said passage, disengaging said lock so as to move said safety valve body in a direction closer to said valve seat by said first urging means, thereby reducing said effective opening of said passage when a rotation rate of said output shaft of said air motor exceeds a predetermined value and said safety valve stopper moves against said urging force of said second urging means due to centrifugal force, and again locking motion of said safety valve body in this state between said safety valve body and said safety valve stopper.

2. An air tool with a safety device as claimed in claim 1, further comprising:

air supply means for supplying at least a minimum amount of air from said air passage when said safety valve body is again locked by said lock mechanism, whereby said air motor continues to turn at a low speed.

3. An air tool with a safety device as claimed in claim 1, wherein:

said rotary member is directly connected to said output shaft of said air motor, and said safety valve body is supported by said rotary member coaxially with a rotational axis thereof.

4. An air tool with a safety device according to claim 3, further comprising:

said speed adjusting valve body being slidably disposed to slide substantially in a coaxial manner;

third urging means for urging said speed adjusting valve body away from said valve seat; and a speed adjusting weight supported on said rotary member in a manner permitting radial displacement thereof by centrifugal force caused by the rotation of said rotary member; and an interlocking mechanism between said speed adjusting valve body and said speed adjusting weight;

said interlocking mechanism reducing said effective opening of said passage by moving said speed adjusting valve body toward said valve seat due to a displacement of said speed adjusting weight.

5. An air tool comprising:

an air motor;

an air passage for feeding air to said air motor;

a speed control valve in said air passage;

a portion of said speed control valve being movable axially of said air motor to control an effective opening thereof related to a rotational speed of said air motor;

an overspeed safety device;

said overspeed safety device including a safety valve stopper rotatable with said air motor;

said safety valve stopper including a safety valve weight;

said safety valve weight being movable radially against resilient urging by centrifigal force when rotational speed of said air motor exceeds a predetermined value;

latching means in said safety valve stopper for latching said safety valve stopper in a quiescent condition when said rotational speed remains below said predetermined value; and said safety valve stopper including coaxially acting means for urging said speed control valve toward a substantially closed position when said safety valve weight is radially displaced a predetermined amount by centrifugal force.

6. An air tool according to claim 5, further comprising:

a second latching means in said safety valve stopper; and said second latching means including means for latching said speed control valve in said substantially closed position when said safety valve stopper is actuated by said centrifugal force, whereby continued use of said air tool is prevented.

7. An air tool according to claim 5, wherein said substantially closed position is a partly open position at which no more than a small amount of air is permitted to flow to said air motor.

* * * * *